US011667005B1

(12) United States Patent
Svensson

(10) Patent No.: US 11,667,005 B1
(45) Date of Patent: Jun. 6, 2023

(54) METHOD OF MAKING PISTON USING POLISHING REMOVAL OF THERMAL BARRIER COATING (TBC) MATERIAL

(71) Applicant: Caterpillar Inc., Peoria, IL (US)

(72) Inventor: Kenth I Svensson, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/730,576

(22) Filed: Apr. 27, 2022

(51) Int. Cl.

| | |
|---|---|
| ***B24B 49/00*** | (2012.01) |
| ***B24B 19/10*** | (2006.01) |
| ***F02F 3/02*** | (2006.01) |
| ***F02F 3/26*** | (2006.01) |

(52) U.S. Cl.
CPC ..... *B24B 19/10* (2013.01); *F02F 3/02* (2013.01); *F02F 3/26* (2013.01); *F02F 2200/00* (2013.01)

(58) Field of Classification Search
CPC ..... C23C 4/02; C23C 28/3455; F02F 3/0084
USPC ..... 451/22
See application file for complete search history.

(56) References Cited

U.S. PATENT DOCUMENTS

| | | | | |
|---|---|---|---|---|
| 10,801,439 | B2 | 10/2020 | Lofskog et al. | |
| 2007/0212519 | A1* | 9/2007 | Nishimura | C23C 4/02 428/141 |
| 2017/0234216 | A1* | 8/2017 | Durrett | C23C 18/1633 428/550 |
| 2018/0128166 | A1* | 5/2018 | Lineton | C23C 28/36 |
| 2018/0179644 | A1* | 6/2018 | Koeberlein | C23C 4/11 |
| 2018/0195126 | A1* | 7/2018 | Gleeson | C12Q 1/6883 |
| 2019/0195126 | A1* | 6/2019 | Schaedler | C23C 4/129 |

FOREIGN PATENT DOCUMENTS

| | | | |
|---|---|---|---|
| JP | 6337639 | B2 | 6/2018 |
| WO | 2015072945 | A1 | 5/2015 |
| WO | 2016096902 | A2 | 6/2016 |

* cited by examiner

*Primary Examiner* — Long T Tran
*Assistant Examiner* — James J Kim
(74) *Attorney, Agent, or Firm* — Brannon Sowers & Cracraft PC

(57) ABSTRACT

Making a piston includes receiving a piston crown including a combustion face forming a combustion bowl. The piston includes a base material, and a thermal barrier coating (TBC) material forming at least a portion of the combustion face including a bowl edge. Making a piston further includes advancing a polishing tool into contact with the combustion face, spinning the polishing tool such that a positive piston profile is polished via contact with a negative tool profile, and removing some of the TBC material based on the spinning the polishing tool relative to the piston.

20 Claims, 3 Drawing Sheets

METHOD OF MAKING PISTON USING POLISHING REMOVAL OF THERMAL BARRIER COATING (TBC) MATERIAL

TECHNICAL FIELD

The present disclosure relates generally to making a piston, and more particularly to polishing thermal barrier coating (TBC) material from a piston combustion face.

BACKGROUND

Pistons used in internal combustion engines are typically subjected to extremely harsh conditions. Pistons are reciprocated rapidly and exposed directly to high combustion pressures and temperatures, in an environment conducive to formation of certain types of deposits and corrosion. In an effort to extend and optimize piston service life, considerable engineering resources have been directed over the years at optimizing the manner in which pistons conduct and dissipate heat to cooling oil as well as the materials and manner of manufacture of various pistons. Pistons for compression-ignition applications, typically in diesel engines, have been the subject of decades of research and development based at least in part on the sensitivity and responsiveness of certain piston geometries and materials to the conditions experienced in service.

Recent years have seen even further attention to optimizing power density of engines, and for this and other reasons engineers are continually seeking strategies for thermal management of components exposed directly to a combustion chamber in an engine. One proposal has been the application of thermal barrier coatings or "TBC's" upon some of the piston surfaces. TBC's typically include multiple layers which perform together to limit heat input into a coated surface, such as a piston. TBC's can be highly sensitive in certain respects to different manufacturing processes, however. One known piston production strategy is set forth in U.S. Pat. No. 4,847,964 to Adams et al. In Adams et al. a steel alloy piston crown is produced from a forging by way of several machining and locating steps.

SUMMARY

In one aspect, a method of making a piston includes receiving a piston crown defining a center axis and including a combustion face having a bowl surface forming a combustion bowl and a center cone within the combustion bowl, an annular rim, and a bowl edge transitioning between the bowl surface and the annular rim. The piston crown includes a base material, and a thermal barrier coating (TBC) material forming at least a portion of the combustion face including the bowl edge. The method further includes advancing a polishing tool into contact with the combustion face, and spinning at least one of the polishing tool or the piston, such that a positive piston profile defined by at least a portion of the annular rim, the bowl edge, and at least a portion of the bowl surface, is polished via contact with a negative tool profile defined by a polishing face of the polishing tool. The method further includes removing some of the TBC material based on the spinning at least one of the polishing tool or the piston.

In another aspect, a method of making a piston includes forming at least a part of a combustion face of a piston of a thermal barrier coating (TBC), and spinning at least one of a polishing tool or the piston. The method further includes contacting a concave bowl surface, a convex rim surface, and a protruding edge of the combustion face to a polishing face of the polishing tool shaped complementarily to the concave bowl surface, the convex rim surface, and the protruding edge of the combustion face, during the spinning at least one of the polishing tool or the piston. The method still further includes removing some of the TBC so as to establish a target thickness and a target profile of the TBC based on the contacting of the combustion face to the polishing face.

In another aspect, a method of preparing a piston for service in an engine includes positioning a protruding edge of a combustion face of a piston in contact with a complementary inverted edge of a polishing face of a polishing tool, and positioning at least one of a rim surface or a bowl surface of the combustion face in contact with the polishing face. The method further includes spinning at least one of the polishing tool or the piston with the protruding edge and the at least one of the rim surface or the bowl surface in contact with the polishing face, and polishing the piston via removal of some of a thermal barrier coating (TBC) material of the combustion face based on the spinning at least one of the polishing tool or the piston.

DETAILED DESCRIPTION

Figure 1:
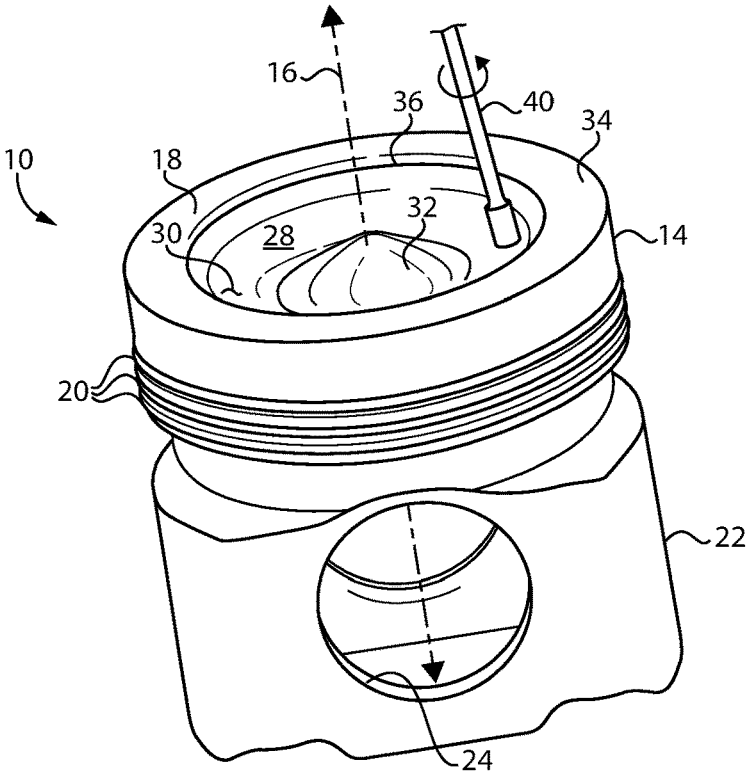
FIG. 1 is a diagrammatic view of a piston at a processing stage, according to one embodiment.

Referring to FIG. 1, there is shown a piston 10 for use in an internal combustion engine. Piston 10 can be installed, typically along with a plurality of other pistons, in a cylinder block and coupled in a conventional manner to an engine crankshaft. Piston 10 includes a one-piece body formed, for example, from two attached forgings including a first forging forming piston crown 14 and a second forging forming a piston skirt 22. Piston 10 can be made from any suitable metallic material such as iron, aluminum, a steel material, a stainless steel material, and various alloys. Piston crown 14 and piston skirt 22 may be formed from the same material or different materials, and may be attached by way of friction welding in some embodiments. Piston crown 14 defines a center axis 16 and includes a combustion face 18 having a bowl surface 28 forming a combustion bowl 30 and a center cone 32 within combustion bowl 30. Combustion face 18 can be understood as the piston top surface that is exposed directly to a combustion chamber in service. Piston crown 14 also includes an annular rim 34, and a protruding bowl edge 36 transitioning between bowl surface 28 and annular rim 34 and externally circumferentially around combustion bowl 30. As further discussed herein, piston crown 14 may include a suitable base material, and a thermal barrier coating (TBC) material forming at least a portion of combustion face 18 including bowl edge 36. A plurality of ring grooves 20 may be formed peripherally around piston crown 14 in a generally conventional manner. A wrist pin bore 24 extends through piston skirt 22 to receive a wrist pin coupling piston 10 to a connecting rod, also in a generally conventional manner. In a practical implementation, piston 10 is configured for use in a compression-ignition engine, such as a conventional four-stroke diesel engine operating on a directly injected diesel distillate fuel. Various alternatives and extensions are nevertheless contemplated, and in some instances piston 10 could be used in a dual liquid fuel engine, a dual liquid and gaseous fuel engine, or in a variety of other fueling and/or operating strategies. Piston 10 is shown in FIG. 1 as it might appear during a machining stage of processing where a machining tool 40 is rotated in contact with surfaces of piston crown 14 including bowl surface 28. The machining stage depicted in FIG. 1 may be one of a rough machining stage or a finish machining stage performed in advance of further processing.

Figure 2:
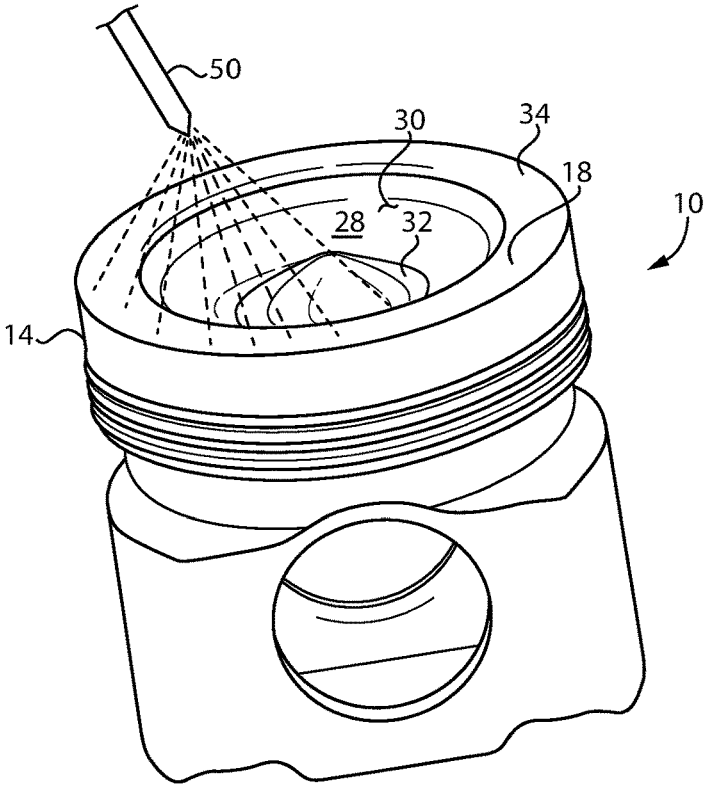
FIG. 2 is a diagrammatic view of a piston at another processing stage, according to one embodiment.

Referring also to FIG. 2, there is shown piston 10 as it might appear having advanced from finish machining and where a thermal barrier coating (TBC) is being applied by way of a spray tool 50. A variety of TBC materials and application processes may be applicable to making piston 10, including deposition of a yttria stabilized zirconia (YSZ) material applied via plasma spraying or another suitable process. It is conventional for application of a TBC to be performed by overspraying, and thus applying more TBC than is desirable which is later finished by way of polishing. In certain known strategies polishing of the TBC is performed by hand. It has been observed that hand-polished TBC's upon pistons can sometimes be associated with certain over-polished or under-polished areas. In particular, certain combustion face features such as sharp corners or edges, can be rounded too much by way of hand polishing. In some instances, tiny radiuses defined by sharp corners or edges can be necessary for optimal combustion, and overly rounded corners such as a bowl edge can cause slower combustion, in turn frustrating efforts at emissions mitigation and/or efficiency. According to the present disclosure final polishing of a TBC upon a combustion face can be achieved via a specially designed and at least partially complementary-shaped polishing tool.

Figure 3:
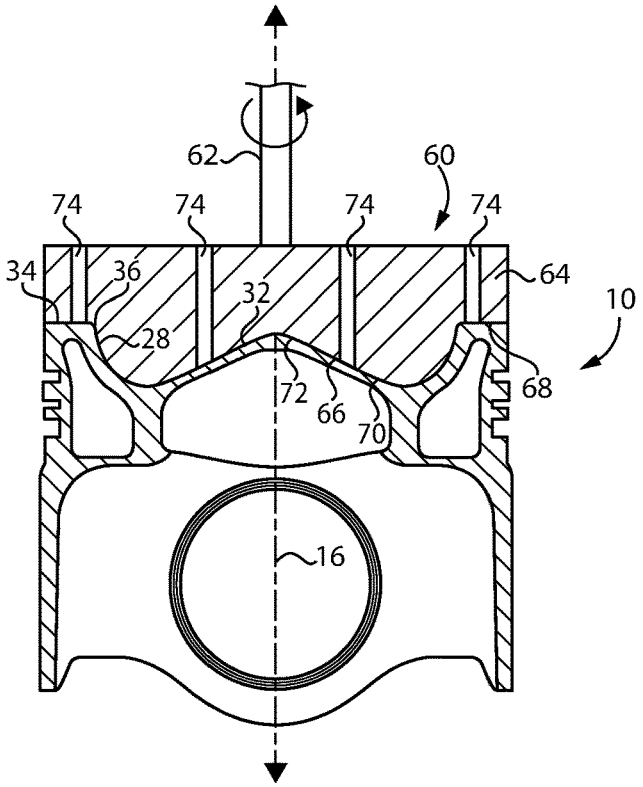
FIG. 3 is a sectioned view of a piston at yet another processing stage, according to one embodiment.

Referring now to FIG. 3, there is shown piston 10 as it might appear where piston crown 14 is received after application of a TBC. A polishing tool 60 is also shown and has been advanced into contact with combustion face 18. From FIG. 3 it can be appreciated that a positive piston profile, that may be axisymmetric about center axis 16, is defined by combustion face 18, and a negative tool profile is defined by a polishing face 66 of a head 64 of polishing tool 60. Head 64 is attached to a shaft or spindle 62 which can be rotated to spin polishing tool 60 relative to piston 10, and such that a positive piston profile defined by at least a portion of annular rim 34, bowl edge 36, and at least a portion of bowl surface 28 is polished via contact with the negative tool profile defined by polishing face 66. Spinning polishing tool 60 in this manner in contact with combustion face 18 can remove some of the TBC material. It can also be appreciated from FIG. 3 that polishing face 66 includes a concave rim section 68 that contacts convex annular rim 34, a convex bowl section 70 that contacts concave bowl surface 28, and a concave cone section 72 that contacts convex center cone 32. It should also be understood that the present description of spinning polishing tool 60 relative to piston 10 contemplates spinning at least one of polishing tool 60 or piston 10. In some embodiments, only piston 10 will be spun, with polishing tool kept stationary.

In the illustrated embodiment, polishing tool 60 can be rotated to polish substantially an entirety of combustion face 18 in a single polishing pass. "Substantially" as used herein generally means all, or nearly all, as would be appreciated by a person of ordinary skill in the art observing polishing of piston 10 or inspecting the same after polishing. It will be recalled the positive piston profile can be understood to be defined by combustion face generally, however, in some instances the positive piston profile polished in a given polishing pass might be less than an entirety of a positive piston profile defined by combustion face 18. In a typical implementation the TBC material extends throughout combustion bowl 30 and also extends throughout annular rim 34 and bowl edge 36. Put differently, an entirety of combustion face 18 may be formed by TBC material. In other embodiments, only a part of combustion face 18 could be formed by TBC material. A lapping compound may also be placed between combustion face 18 and polishing face 66 of polishing tool 60. In some embodiments, polishing face 66 could be coated with a hard material such as a diamond coating. FIG. 3 illustrates openings 74 extending through polishing tool 60 from polishing face 66 and providing fluid communication to and/or from polishing face 66 for feeding of lapping compound and/or conveyance of debris, such as TBC material that is polished from combustion face 18, away from the interface of the rotating components. Lapping compound might in some instances be fed through openings 74 to polishing face 66 and combustion face 18.

Figure 4:
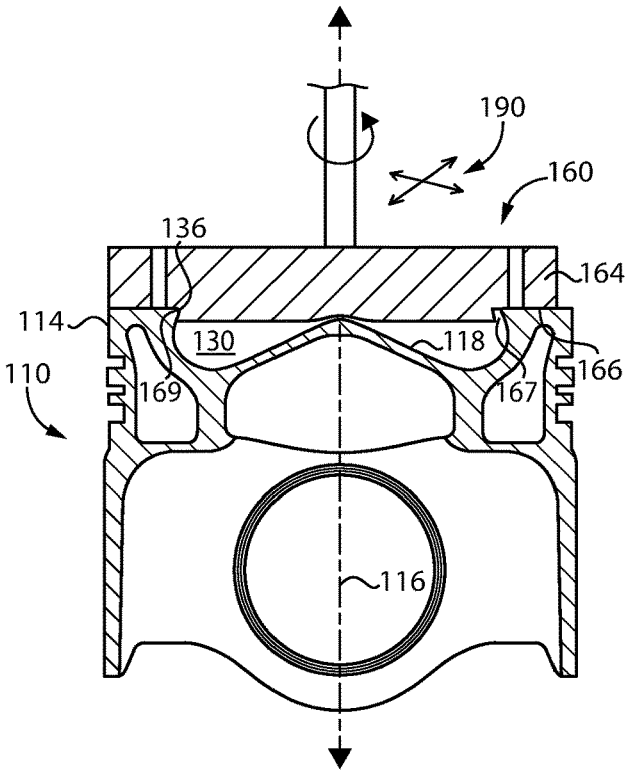
FIG. 4 is a sectioned view of a piston at a processing stage, according to another embodiment.

Referring now to FIG. 4, there is shown a piston 110 including a piston crown 114 defining a center axis 116 and including a combustion face 118 forming a combustion bowl 130 and a bowl edge 136. In the case of piston 110 combustion face 118 can be understood to define a positive piston profile and a polishing tool 160 includes a polishing face 166 defining a negative tool profile. In the illustrated embodiment, the positive piston profile is axisymmetric. In all embodiments, the polishing face can be understood as shaped complementarily to some or all of the combustion face of the respective piston, and typically shaped complementarily to at least a concave bowl surface, convex rim surface, and protruding edge of the combustion face. In the example of FIG. 4 bowl edge 136 can be understood to protrude to a relatively greater extent than does bowl edge 36 in the embodiment of FIG. 3. A radius of curvature defined by bowl edge 136 may be smallest among all radiuses of curvature defined by combustion face 18. Bowl edge 36 in piston 10 may be similarly characterized. Moreover, the positive piston profile defined by combustion face 118 in piston 110 includes a reentrant profile as opposed to the non-reentrant profile of piston 10.

It can further be seen from FIG. 4 that a head 164 of polishing tool 160 is spaced from lower portions of combustion bowl 130. The reentrant profile could, in some instances, cause difficulties in performing all of the desired polishing in a single polishing pass. Thus, another polishing tool or different polishing head can be advanced deeper in a preceding or succeeding pass into combustion bowl 130 than that depicted in the stage of FIG. 4. It can also be seen that polishing tool 160 can be rotated, but also moved laterally, potentially in an X-direction and a Y-direction along axes 190, relative to center axis 116. This strategy of separating a polishing tool into two pieces and polishing in two different stages can enable successful polishing of the relatively deeply reentrant combustion bowl 130 using two different polishing tools in two different polishing passes. To fit an end portion of head 164 into combustion bowl 130 and perform the polishing depicted in FIG. 4 a gap 167 might be formed between head 164 and piston 110, with head 164 caused to advance in an orbital path to complete full circumferential polishing of the desired surfaces. It can also be seen from FIG. 4 that polishing surface 166 may form a complementary inverted edge 169 that is placed in contact with protruding edge 169. Those skilled in the art will appreciate other strategies for successfully polishing a deeply reentrant bowl using a polishing tool shaped complementarily to a combustion face.

Figure 5:
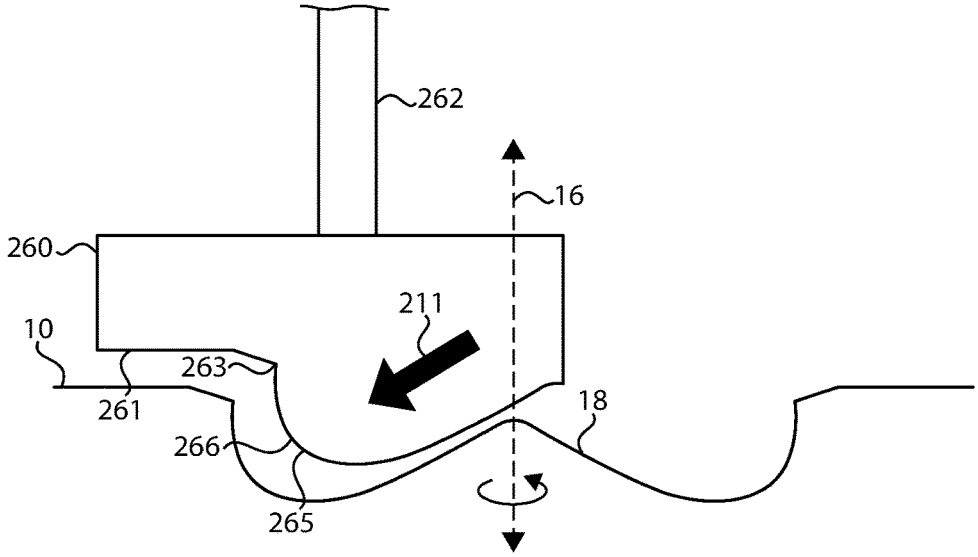
FIG. 5 is a diagrammatic view of a piston at a processing stage, according to another embodiment.

Referring now to FIG. 5, there shown a piston 10 that may be the same or similar to piston 10 of FIGS. 1-3, at a processing stage in proximity to a polishing tool 260. It will be recalled that in some instances, a polishing tool may be rotated to polish a piston, in other instances the piston can be rotated with the polishing tool held stationary, and in still others both the polishing tool and piston might be rotated typically in opposed directions. In FIG. 5 polishing tool 260 includes a shaft 262 and will typically be held stationary while piston 10 is rotated. Polishing tool 260 is shown as it might appear axially spaced from combustion face 18 and radially inward of a location at which a polishing face 266 would contact combustion face 18.

From the state depicted in FIG. 5, piston 10 can be rotated (spun) about center axis 16 and polishing tool 260 advanced generally along a path shown via arrow 211 until polishing face 266 contacts combustion face 18 to commence polishing. As with other embodiments contemplated herein a lapping compound can be placed between polishing face 266 and combustion face 18. With tool 260 in contact with piston 10, polishing can proceed generally in a manner analogous to that described in connection with other embodiments. One or more openings analogous to openings 74 might extend through polishing tool 260 from polishing face 266.

Figure 6:
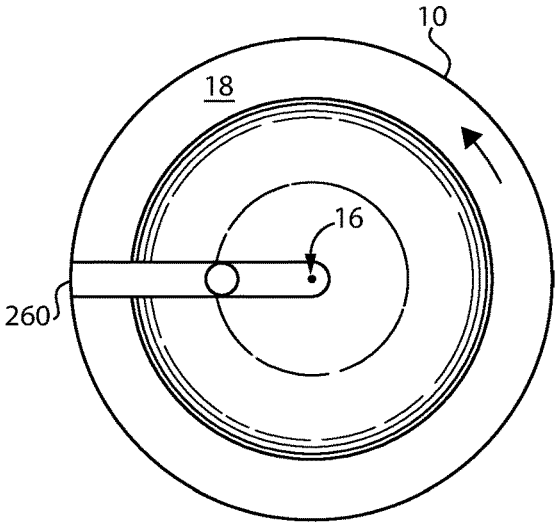
FIG. 6. is another diagrammatic view of a piston at a processing stage as in FIG. 5.
Figure 7:
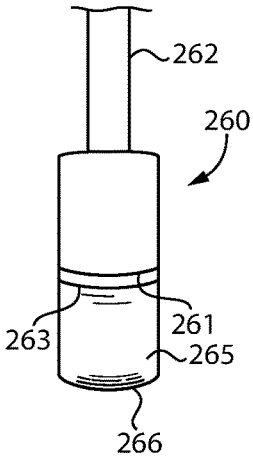
FIG. 7 is a diagrammatic view of a polishing tool, according to one embodiment.

FIG. 6 illustrates a top view of piston 10 and polishing tool 260 with piston 10 rotated around center axis 18 to perform polishing of combustion face 18 while polishing tool 260 is held stationary. Referring also to FIG. 7, there is shown an end view of polishing tool 260. Polishing tool 260 may include a rim section 261 transitioning to an inverted edge 263, and a bowl section 266 transitioning from inverted edge 263. It can be noted that polishing face 266 may be convex in a left to right or thickness direction in some embodiments. It should also be appreciated that while polishing tool 260 is illustrated having a generally uniform thickness, in and out of the page in FIG. 5 and left to right in FIG. 7, in other embodiments a thickness of polishing tool 260 might be varied. For instance, in a radially outward direction, leftward in FIG. 5, polishing tool might be made relatively thicker whereas in a radial inward direction, rightward in FIG. 5, polishing tool 260 might be made relatively thinner. For deeply reentrant combustion bowls, bowl section 265 might be located on a first polishing head and rim section 261 located on a second, different polishing head. Multiple polishing tools or polishing tool pieces or heads could be engaged with a piston in one polishing pass or in separate polishing passes. For purposes of the present disclosure, multiple polishing tools or multiple heads could be understood together to include one polishing face.

INDUSTRIAL APPLICABILITY

Figure 8:
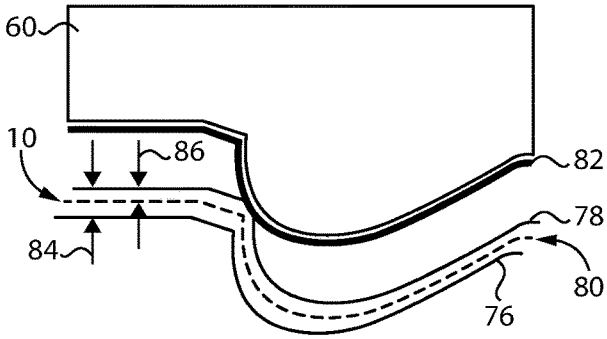
FIG. 8 is a concept view of a portion of a piston and a polishing tool, according to one embodiment.

Referring to the drawings generally, but focusing also now on FIG. 8, making a piston and preparing a piston for service in an engine can include polishing the piston to remove some TBC so as to establish a target thickness of TBC, a target profile, and potentially also a target smoothness for a finished piston. In FIG. 8 polishing tool 60 is shown spaced from piston 10 with a lapping compound 82 upon polishing tool 60. Piston 10 includes a base material 76 such as an iron material or a steel material, and depicted in FIG. 8 approximately as it might appear in profile after finish machining. A TBC material is shown at 78 and illustrates an approximate sprayed profile that might be observed after the processing stage of FIG. 2. A desired polished profile is shown at 80. FIG. 5 also illustrates a starting thickness 84 of the TBC material once sprayed onto the finish machined base material. A bonding compound or other interlayered material might also be placed between the TBC material and the base material. In an implementation, starting thickness 84 might be greater than 0.2 millimeters, for example from about 0.2 millimeters to about 0.5 millimeters (200 μm to 500 μm). A removed thickness of the TBC material is shown at 86 and represents a thickness of the TBC material that is removed by way of by polishing. In one implementation, the TBC material 78 can be removed in a thickness that is at least 0.5 millimeters, and in more particularly from 0.05 millimeters to 0.1 millimeters. In some embodiments 10% or more of a starting thickness of TBC material may be removed by way of the polishing. Depending on the particular TBC used, a finished thickness of TBC material post-polishing might be from 0.1 millimeters to 3 millimeters, and in one practical implementation approximately 0.3 millimeters.

As suggested above, incorrect piston profiles after thermal barrier coating application and polishing are sometimes observed. This may particularly be the case in regard to a sharp piston bowl rim or edge. Employing a negative tool profile made from a material harder than the TBC material and typically including lapping compound, such as polishing paste or buffing compound, can improve consistency and reduce errors in manufacturing particularly with regard to over-polishing sensitive parts of a combustion face.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A method of making a piston comprising:

receiving a piston crown defining a center axis and including a combustion face having a bowl surface forming a combustion bowl and a center cone within the combustion bowl, an annular rim, and a bowl edge transitioning between the bowl surface and the annular rim, and the piston crown including a base material, and a thermal barrier coating (TBC) material forming at least a portion of the combustion face including the bowl edge;

advancing a polishing tool into contact with the combustion face;

spinning at least one of the polishing tool or the piston, such that a positive piston profile defined by at least a portion of the annular rim, the bowl edge, and at least a portion of the bowl surface, is polished via contact with a negative tool profile defined by a polishing face of the polishing tool; and removing some of the TBC material based on the spinning at least one of the polishing tool or the piston.

2. The method of claim 1 further comprising placing a lapping compound between the combustion face and the polishing tool.

3. The method of claim 2 further comprising providing fluid communication to and/or from the polishing face via openings extending through the polishing tool.

4. The method of claim 1 wherein the TBC material extends throughout the combustion bowl.

5. The method of claim 1 wherein the removing some of the TBC material includes removing 10% or more of a thickness of the TBC material.

6. The method of claim 5 wherein the removing some of the TBC material includes removing 0.05 millimeters of the TBC material or greater.

7. The method of claim 1 wherein the positive piston profile includes a reentrant profile.

8. The method of claim 7 wherein the bowl edge defines a radius of curvature smallest among all radiuses of curvature defined by the combustion face.

9. A method of making a piston comprising:

forming at least a part of a combustion face of a piston of a thermal barrier coating (TBC);

spinning at least one of a polishing tool or the piston;

contacting a concave bowl surface, a convex rim surface, and a protruding edge of the combustion face to a polishing face of the polishing tool shaped complementarily to the concave bowl surface, the convex rim surface, and the protruding edge of the combustion face, during the spinning at least one of the polishing tool or the piston; and removing some of the TBC so as to establish a target thickness and a target profile of TBC based on the contacting of the combustion face to the polishing face during the spinning at least one of the polishing tool or the piston.

10. The method of claim 9 wherein the protruding edge of the combustion face includes a bowl edge extending circumferentially around a combustion bowl.

11. The method of claim 10 wherein the combustion face forms a center cone within the combustion bowl.

12. The method of claim 11 wherein the bowl edge defines a radius of curvature smallest among all radiuses of curvature defined by the combustion face.

13. The method of claim 12 wherein the starting thickness is greater than 0.2 millimeters, and the target thickness is at least 0.05 millimeters less than the starting thickness.

14. The method of claim 9 further comprising placing a lapping compound between the combustion face and the polishing face.

15. The method of claim 14 further comprising feeding the lapping compound and/or polished-off particles of the TBC through at least one opening extending through the polishing tool from the polishing face.

16. A method of preparing a piston for service in an engine comprising:

positioning a protruding edge of a combustion face of a piston in contact with a complementary inverted edge of a polishing face of a polishing tool;

positioning at least one of a rim surface or a bowl surface of the combustion face in contact with the polishing face;

spinning the polishing tool relative to the piston with the protruding edge and the at least one of the rim surface or the bowl surface in contact with the polishing face; and polishing the piston via removal of some of a thermal barrier coating (TBC) material of the combustion face based on the spinning the polishing tool relative to the piston.

17. The method of claim 16 wherein the combustion face defines a positive profile, and the polishing face forms a negative profile.

18. The method of claim 17 wherein the positive profile is defined by the rim surface, the bowl surface, and the protruding edge, and is axisymmetric about a piston center axis.

19. The method of claim 18 wherein the positive profile includes a bowl reentrant profile.

20. The method of claim 16 wherein the polishing the piston includes polishing substantially an entirety of the combustion face in a single polishing pass.

* * * * *